United States Patent [19]

Itagaki

[11] Patent Number: 4,598,504

[45] Date of Patent: Jul. 8, 1986

[54] WALL DISPLAY STRUCTURE

[75] Inventor: Takafumi Itagaki, Urayasu, Japan

[73] Assignee: Tamatoshi Industries Ltd., Tokyo, Japan

[21] Appl. No.: 566,999

[22] Filed: Dec. 30, 1983

[30] Foreign Application Priority Data

Mar. 3, 1983 [JP] Japan ..... 58-34959
Mar. 3, 1983 [JP] Japan ..... 58-30978

[51] Int. Cl.[4] ..... A47G 29/02

[52] U.S. Cl. ..... 52/36; 248/243; 211/87

[58] Field of Search ..... 108/102, 106, 107; 52/710, 36; 248/243, 250; 211/87

[56] References Cited

U.S. PATENT DOCUMENTS

| | | | |
|---|---|---|---|
| 2,125,136 | 7/1938 | Trojanowski | 52/710 |
| 2,788,902 | 4/1957 | Nowicki | 248/250 |
| 3,574,980 | 4/1971 | Keller | 248/243 |
| 3,698,565 | 10/1972 | Weber | 211/87 |
| 4,030,612 | 6/1977 | Gray | 108/107 |

*Primary Examiner*—James L. Ridgill, Jr.

*Attorney, Agent, or Firm*—Oblon, Fisher, Spivak, McClelland & Maier

[57] ABSTRACT

A wall display structure which includes a plurality of ornamental panels, mirrors or other plate-like modular members which are aligned on a surface of a wall of a shop (supermarket) or the like. Transverse channels are formed between each two vertically adjacent modular panels for holding hook elements for hooking articles thereon. Ornamental elements are arranged in the transverse channels so as not to expose the wall surface through the channels.

Each transverse channel is defined by support members for mounting the modular panels on the wall at intervals.

The support members integrally have a partitioning wall for partitioning the interior of the transverse channel into an element housing for receiving the element and a hook engaging groove for receiving the hook elements.

The partitioning of the transverse channel prevents the ornamental element fitted in the ornamental element housing from being damaged by the hook elements mounted in the hook engaging groove.

8 Claims, 15 Drawing Figures

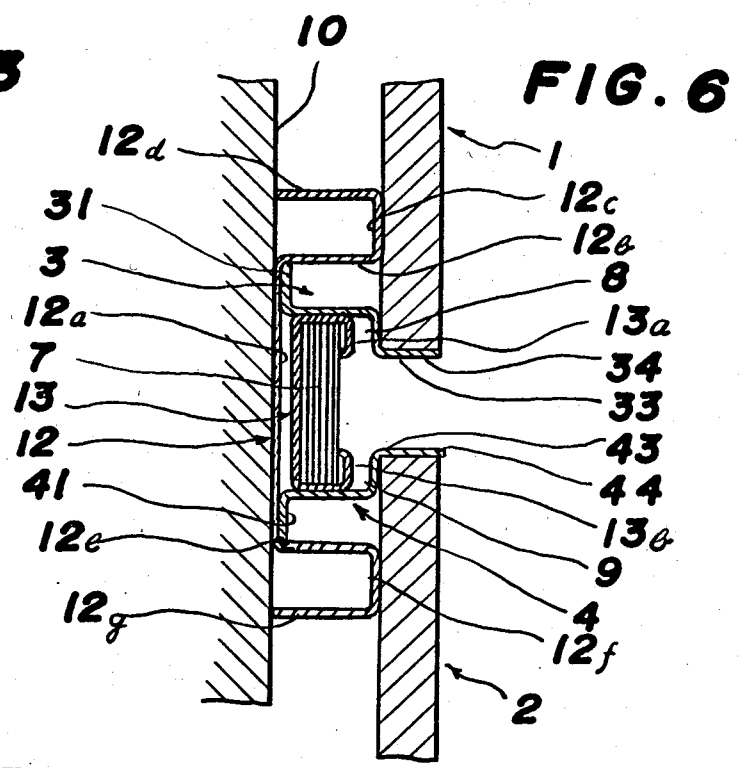
FIG. 6
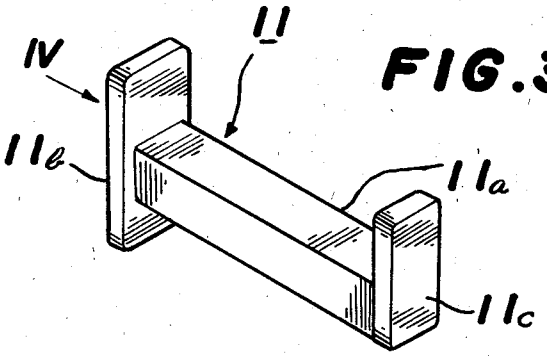
FIG. 3
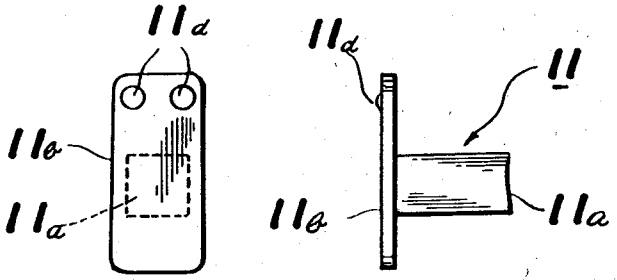
FIG. 5
FIG. 4

110
111
112
113
114
115
116
117A
117B
117C
117D
117E
340
S
M

WALL DISPLAY STRUCTURE

BACKGROUND OF THE INVENTION

1. Field of the Invention

This invention relates to a display panel apparatus for holding articles to be displayed such as sales goods through hook elements and, more particularly, to a display panel apparatus wherein hook channels for mounting the hook elements therein also satisfy a requirement for an ornamental effect.

2. Discussion of the Background

A structure is conventionally known wherein a rectangular modular panel is mounted at a distance from and parallel to a vertical mounting surface such as a room wall, and a narrow opening is formed in the modular panel to extend horizontally. Another structure is also conventionally known wherein modular panels are vertically spaced apart from each other to define a narrow opening therebetween similar to that described above.

In such a structure, the narrow opening communicates with the space between the mounting surface and the modular panel. The mount base portion of the hook element is inserted in the narrow opening and is fixed behind the modular panel either above or below the narrow opening.

The narrow opening extends transversely, that is, horizontally. At a portion of the narrow opening at which no hook element is inserted, a portion of the mounting surface is exposed through the narrow opening, thus impairing the outer appearance of the display structure.

A structure may then be proposed wherein the portion of the mounting surface which may be exposed through the narrow opening is colored, or an ornamental plate or the like is mounted on such a portion of the mounting surface which may be exposed.

However, if such a structure is to be adopted, before the modular panel is mounted, the mounting surface must be colored or an ornamental plate or the like must be mounted on the mounting surface. This results in an additional installation step, and requires precise positioning for coloring the mounting surface or fixing an ornamental plate or the like thereto.

Still another structure is proposed in U.S. Pat. No. 3,698,565. According to this structure, a plate-like panel section is formed integrally with lips having substantially L-shaped sections which project upward and downward by equal amounts from the panel section to define an opening between the upper and lower lips, and a hook element is mounted in the groove of the L-shaped lip which faces downward.

Still another structure is proposed in Japanese Utility Model Disclosure No. 58-14763, No. 58-14764, and U.S. Pat. Ser. No. 498,784. According to this structure, a panel section as a wall member is formed integrally with lips having transversely L-shaped sections projecting upward and downward by equal amounts from the panel section, thereby defining a narrow opening between the upper and lower lips.

In the last two structures, a panel section is mounted to cover the mounting surface. For this reason, the mounting surface may not be exposed through the narrow opening. If the panel section is colored or painted together with the lips, mounting procedures may be simplified, and a better ornamental effect may also be obtained.

However, with these structures, when the distance between the vertically opposing lips which corresponds to the vertical size of the modular panel is large, the problem of weak mechanical strength is presented. Furthermore, loss of material is significant.

In addition to these problems, when the hook element is inserted through the opening, the mount base portion may be directly abutted against the panel section, and this may lead to damage or contamination of the ornamental portion.

SUMMARY OF THE INVENTION

One of the objects of the invention is to provide a wall display structure wherein at least those portions of transverse channels formed between vertically aligned modular panels and for receiving hook elements which are externally visible are covered with and concealed by ornamental elements.

Another object of the invention is to provide a wall display structure wherein ornamental elements may not be damaged by hook elements mounted in transverse channels.

Still another object of the invention is to provide a wall display structure wherein ornamental elements are detachable to allow various combinations of the ornamental elements and modular panels.

Still another object of the present invention is to provide a wall display structure having hook elements which can be securely mounted in transverse channels.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 3 is a partial perspective view showing an example of a display holding hook element;

FIG. 4 is an elevation of the element shown in FIG. 3 as viewed along the arrow therein;

FIG. 5 is a partial side view of the hook element shown in FIG. 3;

FIG. 6 is a sectional view showing a joint portion of a wall display structure according to a second embodiment of the invention;

DESCRIPTION OF THE PREFERRED EMBODIMENTS

The preferred embodiments of the invention will now be described with reference to the accompanying drawings.

Figure 1:
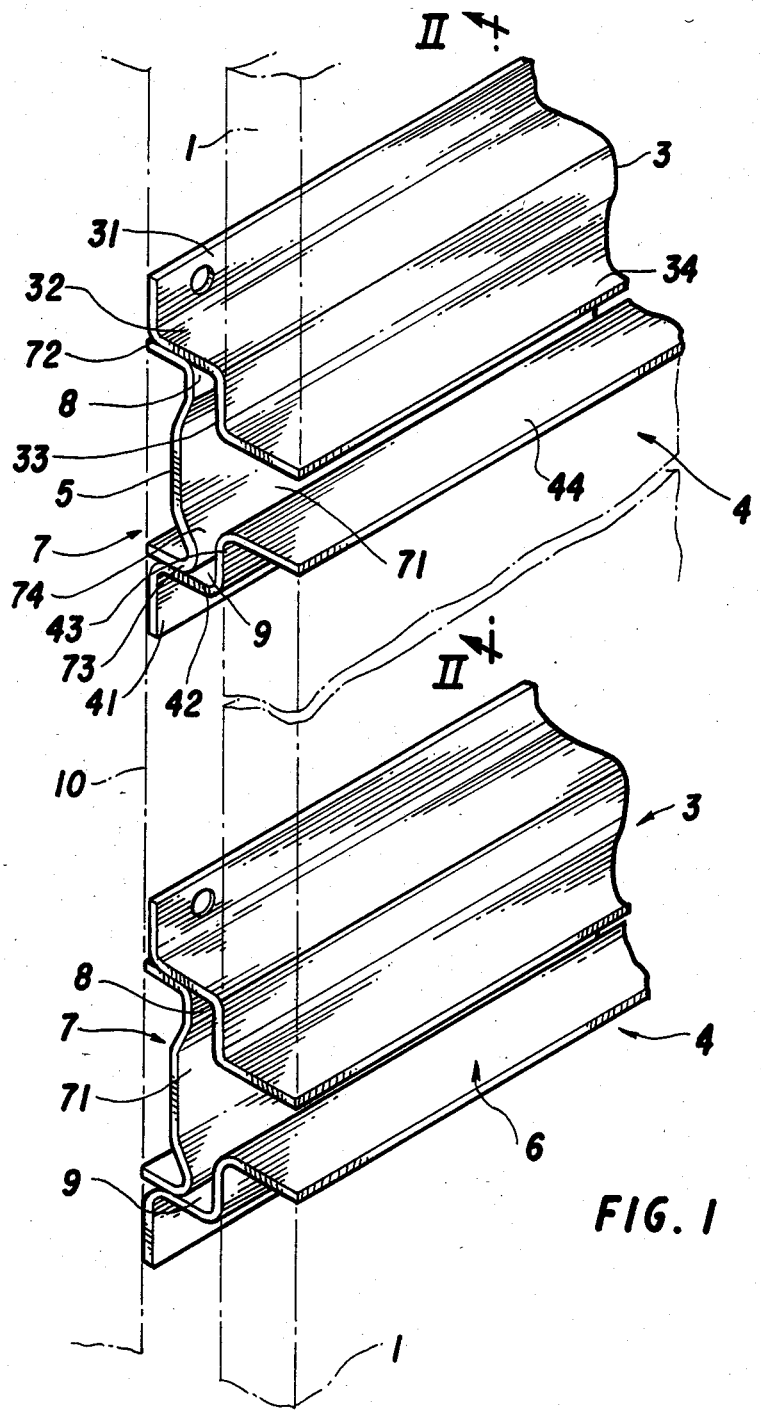
FIG. 1 is a partial perspective view of a wall display structure according to a first embodiment of the invention.
Figure 2:
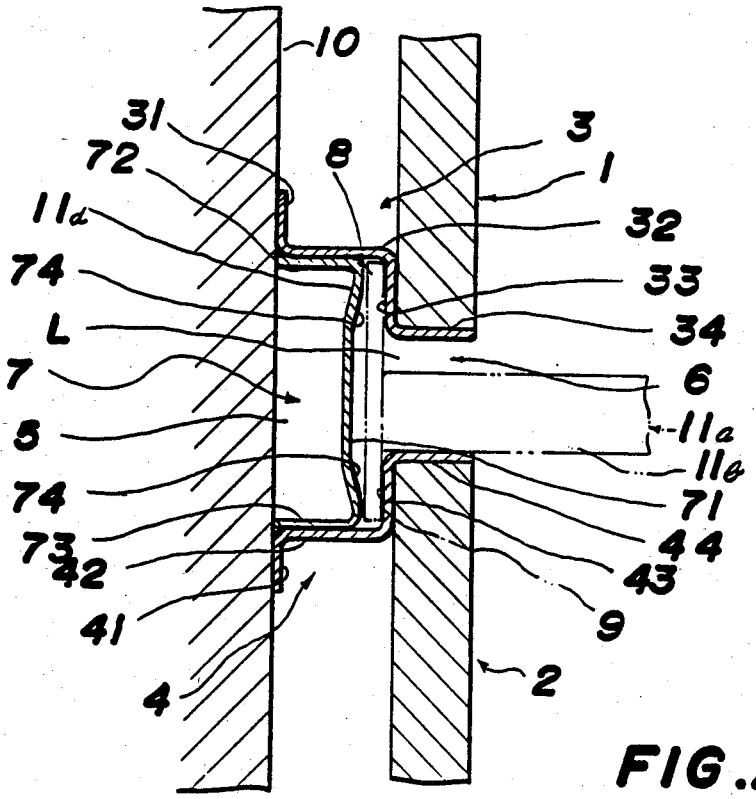
FIG. 2 is a sectional view of the structure shown in FIG. 1 along line II—II therein.

As shown in FIGS. 1 and 2, a wall display structure of the invention has a plurality of modular panels 1 and 2 for covering a mounting surface 10 such as a room wall of a shop.

The modular panels 1 and 2 may comprise members constituting wall coverings such as ornamental panels or boards, colored glasses, or mirrors.

A plurality of such modular panels 1 and 2 are vertically arranged next to each other at equal intervals on the mounting surface 10.

The upper and lower edges of each of the modular panels 1 and 2 are held by support members 4 and 3, respectively, which are fixed to the mounting surface 10 by means of an adhesive, nails, screws or the like.

The support members 3 and 4 comprise, in this case, separate stainless steel members. The number of each of the support members 3 and 4 corresponds to that of the modular panels 1 and 2 used.

The upper support member 3 of each pair of support members 3 and 4 supporting the lower edge of the upper modular panel 1 between the modular panels 1 and 2 has an upwardly extending mount flange portion 31 which is fixed to the mounting surface 10 and extends continuously along the longitudinal direction of the support member 3 to be parallel to the mounting surface 10.

The lower edge of the flange portion 31 extends horizontally outward to form a rib portion 32 which also extends continuously along the longitudinal direction of the support member 3.

A web portion 33 depends from the distal end of the web portion 32 to extend along the longitudinal direction of the support member 3 and parallel to the mounting surface 10.

A distal end flange portion 34 extends horizontally outward from the lower edge of the web portion 33 to extend continuously along the longitudinal direction of the support member 3.

In the upper support member 3 having such a construction, the lower portion of the rear surface of the modular panel 1 is abutted against the outer surface of the web portion 33, and the lower end face of the modular panel 1 is abutted against the upper surface of the distal end flange portion 34.

In this state, the lower portion of the upper modular panel 1 is either adhered to the web portion 33 and the distal end flange portion 34, or is screwed to the web portion 33.

In this manner, the upper support member 3 supports the lower end portion of the upper modular panel 1 in a fixed position.

Another support member 3 having the same shape as that of the upper support member 3 described above similarly supports the lower end portion of the lower modular panel 2.

The lower support member 4 supporting the upper edge of the lower modular panel 2 has a downwardly extending mount flange portion 41 which is fixed to the mounting surface 10 at a position a certain distance below the upper support member 3, and which is parallel to the upper support member 3.

A rib portion 42 extends horizontally outward from the upper edge of the flange portion 41 to extend continuously along the longitudinal direction of the support member 4.

A web portion 43 extends vertically upward from the distal end of the rib portion 42 so as to extend along the longitudinal direction of the support member 4 and parallel to the mounting surface 10.

A distal end flange portion 44 extends horizontally outward from the upper end of the web portion 43 so as to extend continuously along the longitudinal direction of the support member 4 and parallel to the distal end flange portion 34 of the upper support member 3. The distal end flange portion 44 serves to support the upper end portion of the lower modular panel 2.

In this manner, the upper portion of the rear surface of the lower modular panel 2 is abutted against the outer surface of the web portion 43 of the lower support member 4, and the upper end face of the lower modular member 2 is abutted against the lower surface of the distal end flange portion 44.

In this state, the upper portion of the lower modular panel 2 is either adhered to the web portion 43 and the distal end flange portion 44 or is screwed to the web portion 43.

The lower support member 4 thus serves to fix in position the upper portion of the lower modular panel 2.

Another support member 4 having the same shape as that of the lower support member 4 described above similarly supports the upper portion of the upper modular panel 1.

As may be apparent from the above description, the upper and lower support members 3 and 4 have symmetrical shapes.

For this reason, support members of the same shape can be used as upper and lower support members by simply turning them upside down.

The paired support members 3 and 4 define therebetween a transverse channel 5 and a front opening 6 thereof.

The transverse channel 5 is defined by the rib portions 32 and 42 of the support members 3 and 4, the portion of the mounting surface 10 between the rib portions 32 and 42, and the web portions 33 and 43, and extends continuously along the longitudinal direction of the supports 3 and 4.

The front opening 6 is defined by the distal end flange portions 34 and 44 of the support members 3 and 4, extends along the longitudinal direction thereof, and communicates with the transverse channel 5.

When no further measure is taken, the portion of the mounting surface 10 which is exposed through the transverse channel 5 and which is not covered by the modular panels 1 and 2 is exposed to be externally visible through the front opening 6.

In order to prevent this, an element 7 for covering and concealing such a portion of the mounting surface 10 is positioned entirely inside the transverse channel 5.

The element 7 comprises an elongated member of stainless steel or the like and has a channel-like section. A web surface 71 of the element 7 is subjected to an ornamental treatment such as chromium plating or color painting.

The element 7 having such a web surface 71 as an ornamental surface is fitted inside the transverse channel 5 such that the web surface 71 faces outward through the front opening 6.

Upper and lower flange portions 72 and 73 of the element 7 are arranged to be in contact with the rib portions 32 and 42, respectively, with no space therebetween.

The element 7 thus also serves as a spacer to maintain a predetermined distance between the upper and lower supports 3 and 4.

In the element 7 as described above, the web surface 71 is spaced apart from the web portions 33 and 43 of the support means 3 and 4, respectively. The upper and lower flange portions 72 and 73 are integrally formed with the rib portions 32 and 42 by spot welding or the like.

With this construction, the support members 3 and 4 and the element 7 comprise an integral unit structure having predetermined positional relationships. Thus, the support members 3 and 4 and the element 7 can be mounted on the mounting surface 10 with ease.

The distance between the web surface 71 and the web portions 33 and 43 of the support members 3 and 4 is set to correspond to the thickness of a mount base portion 11*b* at the proximal end of a hook element 11.

An upper hook engaging groove 8 is formed to open downward between the upper end of the web surface 71 and the web portion 33 of the upper support member 3 so as to receive the upper end of the mount base portion 11*b*.

Similarly, a lower hook engaging groove 9 is formed to open upward between the lower end of the web surface 71 and the web portion 43 of the lower support member 4 and immediately below the upper hook engaging groove 8. The lower hook engaging groove 9 receives the lower end of the mount base portion 11*b*.

The hook engaging grooves 8 and 9 have gradually tapered openings to allow easy insertion of the mount base portion 11*b* therein. The tapered openings of the hook engaging grooves 8 and 9 are formed by tapered surfaces 74 formed in the web surface 71 of the element 7.

A hook element to be used herein must have a suitable hook structure for engagement with the upper hook engaging groove 8 and/or lower hook engaging groove 9 (this also applies to other embodiments to be described below). As an example of such a hook element, a hook element 11, as shown in detail in FIGS. 3 to 5, has a structure wherein the mount base portion 11*b* is formed integrally with one end of a hook shaft 11*a*, and an article hook portion 11*c* is formed integrally with the other end of the hook shaft 11*a*.

The mount base portion 11*b* comprises a substantially rectangular plate which extends vertically in a plane perpendicular to the hook shaft 11*a*, which has a substantially square section. When the longitudinal direction of the mount base portion 11*b* is aligned with the longitudinal direction of the front opening 6, it can be inserted through the opening 6.

The mount base portion 11*b* has two semispherical projections 11*d* formed integrally with the surface thereof opposite to the surface with which the hook shaft 11*a* is integrally formed.

The projections 11*d* serve to reduce any frictional force acting between the web surface 71 of the element 7 and the mount base portion 11*b*.

The article hook portion 11*c* comprises, in this embodiment, a plate which stands upward and parallel to the mount base portion 11*b*. However, any other construction may be adopted for the article hook portion 11*c* as long as it is capable of hooking an article thereon.

The hook element 11 as described above is mounted to the wall display structure as described above in accordance with the following manner.

The longitudinal direction of the mount base portion 11*b* is aligned with that of the front opening 6, and the mount base portion 11*b* is inserted into the transverse channel 5.

Then, the mount base portion 11*b* is abutted against the web surface 71 of the element 7.

When the hook shaft 11*a* is turned through 90 degrees, the longitudinal direction of the mount base portion 11*b* is aligned with the vertical direction, so that the upper and lower ends of the mount base portion 11*b* are inserted into the hook engaging grooves 8 and 9, respectively.

The hook element 11 is therefore securely hooked and cannot be inadvertently removed from the front opening 6.

In the second embodiment shown in FIG. 6, support members 3 and 4 are mounted on a mounting surface 10 through a base panel 12.

The base panel 12 consists of a main panel portion 12*a* in contact with the mounting surface 10, and upper and lower rib portions 12*b* and 12*e* extend horizontally outward from the upper and lower edges of the main panel portion 12*a*, and extend continuously along the longitudinal direction of the panel 12.

A web portion 12*c* extends upward from the distal end of the upper rib portion 12*b*.

A web portion 12*f* depends perpendicularly from the distal end of the lower rib portion 12*e*.

Flange portions 12*d* and 12*g* extend from the distal ends of the web portions 12*c* and 12*f*, respectively, toward the mounting surface 10.

The base panel 12 having the construction as described above is mounted on the mounting surface 10 such that the main panel portion 12*a* is screwed to the mounting surface 10 together with mount flange portions 31 and 41 of the support members 3 and 4, respectively.

In this case, the mount flange portions 31 and 41 of the support members 3 and 4, respectively, are superposed on the main panel portion 12*a* such that the edges of the respective mount flange portions 31 and 41 are abutted against the upper and lower rib portions 12*b* and 12*e*, respectively.

In this manner, the relative positions of the base panel 12 and the support members 3 and 4, and the interval between the support members 3 and 4, are determined.

An element 7 in this second embodiment comprises an plate such as a colored glass plate, a mirror, a synthetic resin plate, or a board, and is clamped by a holder member 13.

The holder member 13 comprises a stainless steel member having a substantially U-shaped section. Flange portions 13*a* and 13*b* of the holder member 13 hold and clamp the ornamental element 7 therein.

The width of front bent portions of the flange portions 13*a* and 13*b* is set such that the front bent portions are not externally visible behind the web portions 33 and 43 of the support members 3 and 4.

The holder member 13 clamping the element 7 therein is fitted in a transverse channel 5 defined between the support members 3 and 4 such that the upper and lower flange portions 13*a* and 13*b* are separated from the respective rear surfaces of the web portions 33 and 43 of the support members 3 and 4.

Fitting of the holder member 13 in the transverse channel 5 may be achieved by integrally forming the holder 13 and the support members 3 and 4 in advance, such that the upper and lower ends of the holder member 13 are separated from the inner surfaces of rib portions 32 and 42 of the support members 3 and 4, respectively.

As described above, since the flange portions 13*a* and 13*b* of the holder member 13 are separated from the web portions 33 and 43 of the support members 3 and 4, upper and lower hook engaging grooves 8 and 9 are formed between these opposing portions, as in the case of the first embodiment.

In the second embodiment, the front surfaces of the web portions 12*c* and 12*f* of the base panel 12 and the front surfaces of the web portions 33 and 43 of the support members 3 and 4 are abutted against or are adhered to the rear surfaces of modular panels 1 and 2. As in the case of the first embodiment, the lower end face of the upper modular panel 1 is abutted against or is adhered to the upper surface of a distal end flange portion 34 of the upper support member 3. At the same time, the upper end face of the lower modular panel 2 is abutted against and is adhered to the lower end face of a distal end flange portion 44 of the lower support member 4.

The modular panels 1 and 2 are either adhered to the web portions 12*c*, 12*f*, 33 and 43 and the distal end flange portions 34 and 44, or are screwed to the web portions 12*c* and 12*f* of the base panel 12.

In the complete wall display structure as described above, the mount base portion 11*b* of the hook element 11 as shown in FIGS. 3 to 5 is fitted in and engaged with the upper and lower hook engaging grooves 8 and 9, in the same manner as that described with reference to the first embodiment.

In addition to the same effects as those obtained in the first embodiment, according to the second embodiment, the element 7 to be set between the support members 3 and 4 may be arbitrarily selected.

Figure 7:
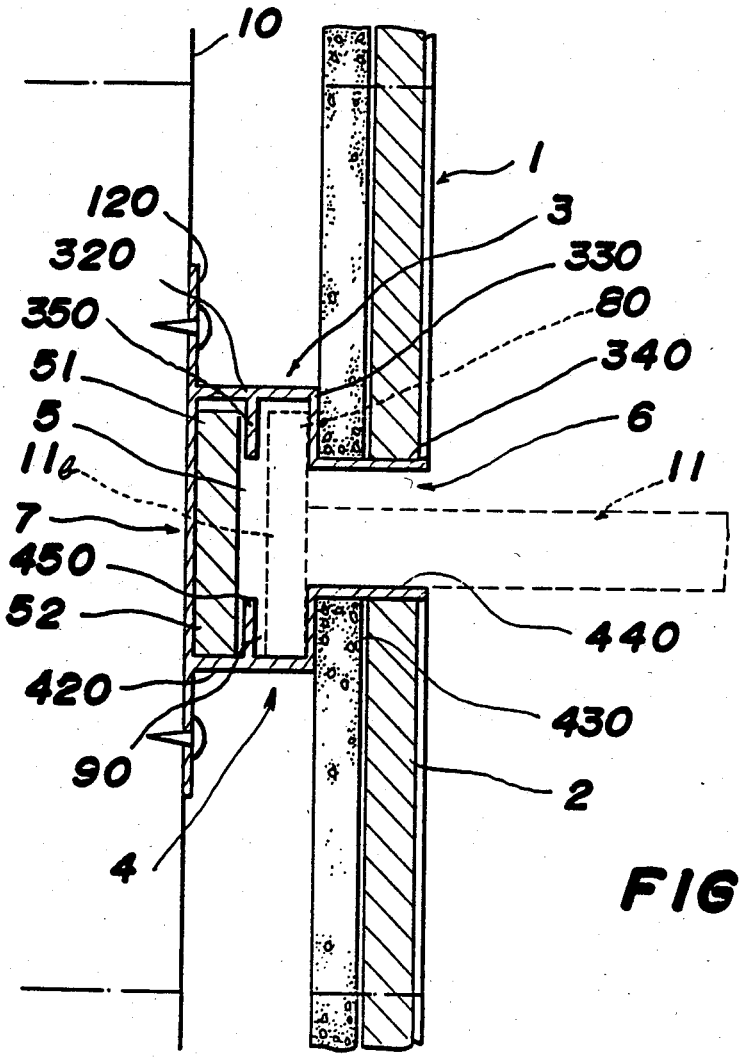
FIG. 7 is a sectional view showing a joint portion of a wall display structure according to a third embodiment of the invention.

In the third embodiment shown in FIG. 7, support members 3 and 4 comprise an integral body having a base plate portion 120.

The base plate portion 120 is fixed to a mounting surface 10 by screwing or adhesion. The base plate portion 120 has upper and lower rib portions 320 and 420 which extend horizontally outward to be parallel to each other, and extend continuously in the longitudinal direction of the integral body of the support members 3 and 4.

Web portions 330 and 430 extend vertically downward and upward, respectively, from the respective distal ends of the rib portions 320 and 420.

Flange portions 340 and 440 extend horizontally outward from the lower and upper edges of the web portions 330 and 430, respectively.

Accordingly, the support members 3 and 4 have a transverse channel 5 which is defined by the base plate portion 120, the rib portions 320 and 420, and the web portions 330 and 430; and which also has a front opening 6 which opens between the flange portions 340 and 440.

In the support members 3 and 4 described above, a pair of inward projections 350 and 450 are formed integrally with the inner surfaces of the upper and lower rib portions 320 and 420, respectively, so as to extend vertically downward and upward, respectively, to oppose each other, and to extend continuously in the longitudinal direction of the integral body of the support members 3 and 4.

The inward projections 350 and 450 have the same or shorter length than that of the web portions 330 and 430 such that they may not be exposed behind these web portions 330 and 430.

As such, the inward projections 350 and 450 partition the interior of the transverse channel 5 into a portion at the side of the base plate portion 120 and a portion at the side of the front opening 6.

In the space defined between the base plate portion 120 and the inward projections 350 and 450, an upper channel portion 51 opens downward and a lower channel portion 52 opens upward immediately below the upper channel portion 51 to be parallel thereto.

An element 7 is slidably fitted in the upper and lower channel portions 51 and 52.

In this case, the element 7 covers the surface of the base plate portion 120 such that the surface of the base plate portion 120 may not be exposed through the transverse channel 5.

Holes may be formed in the portion of the base plate portion 120 which is covered with the ornamental element to an extent which does not impair the mechanical strength thereof, to make the overall structure lighter in weight.

In this case, the element 7 covers, giving an ornamental effect, the surface of the base plate portion 120 and portions of the mounting surface 10 which are exposed through the holes formed in the base plate portion 120.

An upper hook engaging groove 80 is defined between the inward projection 350 and the web portion 330. Similarly, a lower hook engaging groove 90 is defined between the inward projection 450 and the web portion 430. These upper and lower hook engaging grooves 80 and 90 serve to engage with a hook element 11 similar to that used in the first or second embodiment.

The lower end of an upper modular plate 1 is fixed to the upper support member 3, while the upper end of a lower modular plate 2 is fixed to the lower support member 4 by a means similar to that used in the former embodiments.

Thus, a wall display structure for covering the mounting surface 10 at predetermined intervals is obtained.

The hook elements 11 are mounted at proper positions of the transverse channel 5 of this structure.

Each hook element 11 can be mounted in the transverse channel 5 as in the case of the former embodiments. More specifically, a mount base portion 11*b* of the hook element 11 inserted through the front opening 6 is fitted inside the upper and lower hook engaging grooves 80 and 90.

Since the hook element 11 to be used in this embodiment is similar to that shown in FIGS. 3 to 5, a description thereof will be omitted.

Figure 8:
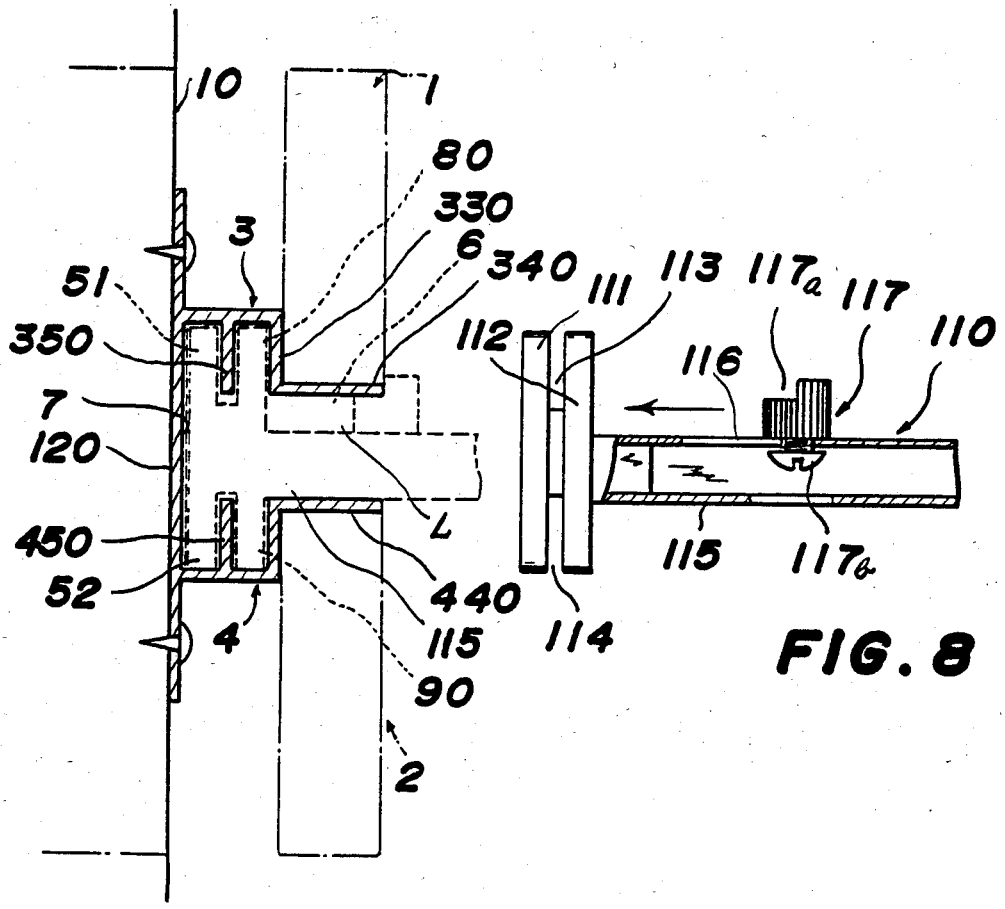
FIG. 8 is a sectional view showing a joint portion of a wall display structure according to a fourth embodiment of the invention together with a modification of the hook element.

In the case of the fourth embodiment shown in FIG. 8, support members 3 and 4 have the same sectional shape as that of the third embodiment.

More specifically, in this fourth embodiment, an element 7 is mounted on a base plate portion 120 of the support members 3 and 4.

In the fourth embodiment, however, the element 7 is formed integrally with the surface portion of the base plate portion 120 which may be exposed through a front opening 6 of a transverse channel 5.

Inward projections 350 and 450 of the support members 3 and 4, respectively, serve as hook portions for engaging with a hook element 110.

Accordingly, the hook element 110 to be used in this embodiment is different from the hook element 11 used in the former embodiments.

To describe it in more detail, the hook element 110 has integrally formed outer and inner mount base portions 111 and 112, respectively. The outer mount base portion 111 is fitted in and engages with upper and lower channel portions 51 and 52. The inner mount base portion 112 is fitted in and engages with upper and lower hook engaging grooves 80 and 90.

The outer and inner mount base portions 111 and 112 are formed integrally to extend parallel to each other at a predetermined distance apart. Thus, the outer and inner mount base portions 111 and 112 define therebetween hook groove portions 113 and 114 which respectively receive the inward projections 350 and 450 therein.

A hook shaft 115 extends from the inner mount base portion 112 in the direction away from the outer mount base portion 111.

The hook shaft 115 is hollow and has a stopper guide hole 116 on its upper surface which extends along the longitudinal direction of the hook shaft 115.

A stopper 117 is mounted in the guide hole 116 so as to be slidable in the axial or longitudinal direction of the hook shaft 115.

The stopper 117 has a stepped portion 117*a* formed on its upper surface and facing the side of the base mount portion 112, and a leg portion 117*b* loosely received in the guide hole 116.

The relationship between the hook element 110 and the support members 3 and 4 will now be described.

The base mount portions 111 and 112 of the hook element 110 are inserted into the transverse channel 5 through the front opening 6 in the same manner as the mount base portion 11*b* of the hook element 11 used in the former embodiments.

During such insertion, the outer mount base portion 111 is passed through the front opening 6 and then through the space between the inward projections 350 and 450.

However, the inner mount base portion 112 is only passed through the front opening 6.

In this state, the stopper 117 is oriented along the longitudinal direction of the integral body of the support members 3 and 4.

When the hook shaft 115 of the hook element 110 is pivoted through 90 degrees such that the stopper 117 is oriented upward, the base mount portions 111 and 112 are oriented vertically. Thus, the inward projections 350 and 450 are respectively fitted inside the hook groove portions 113 and 114.

In this state, a clearance L is defined between the flange portion 340 of the upper support member 3 and the hook shaft 115.

The height of the stepped portion 117*a* of the stopper 117 is set to substantially equal the clearance L.

When the stopper 117 is slid toward the front opening 6, the stepped portion 117*a* is fitted into the clearance L. Then, the hook element 110 mounted between the modular panels 1 and 2 is fixed securely in position by the stopper 117 and may not inadvertently move.

A load of an article acting on the hook element 110 is dispersed to the mounting surface 10 and the modular panels 1 and 2 through the mount base portions 111 and 112, so that a concentrated load may not act locally on the hook element 110.

In the case shown in the drawing, the leg portion 117*b* comprises a screw threaded into the lower surface of the stopper 117. The head of the screw prevents the stopper 117 from being accidentally removed from the hook shaft 115.

Figures 9, 10, 11:
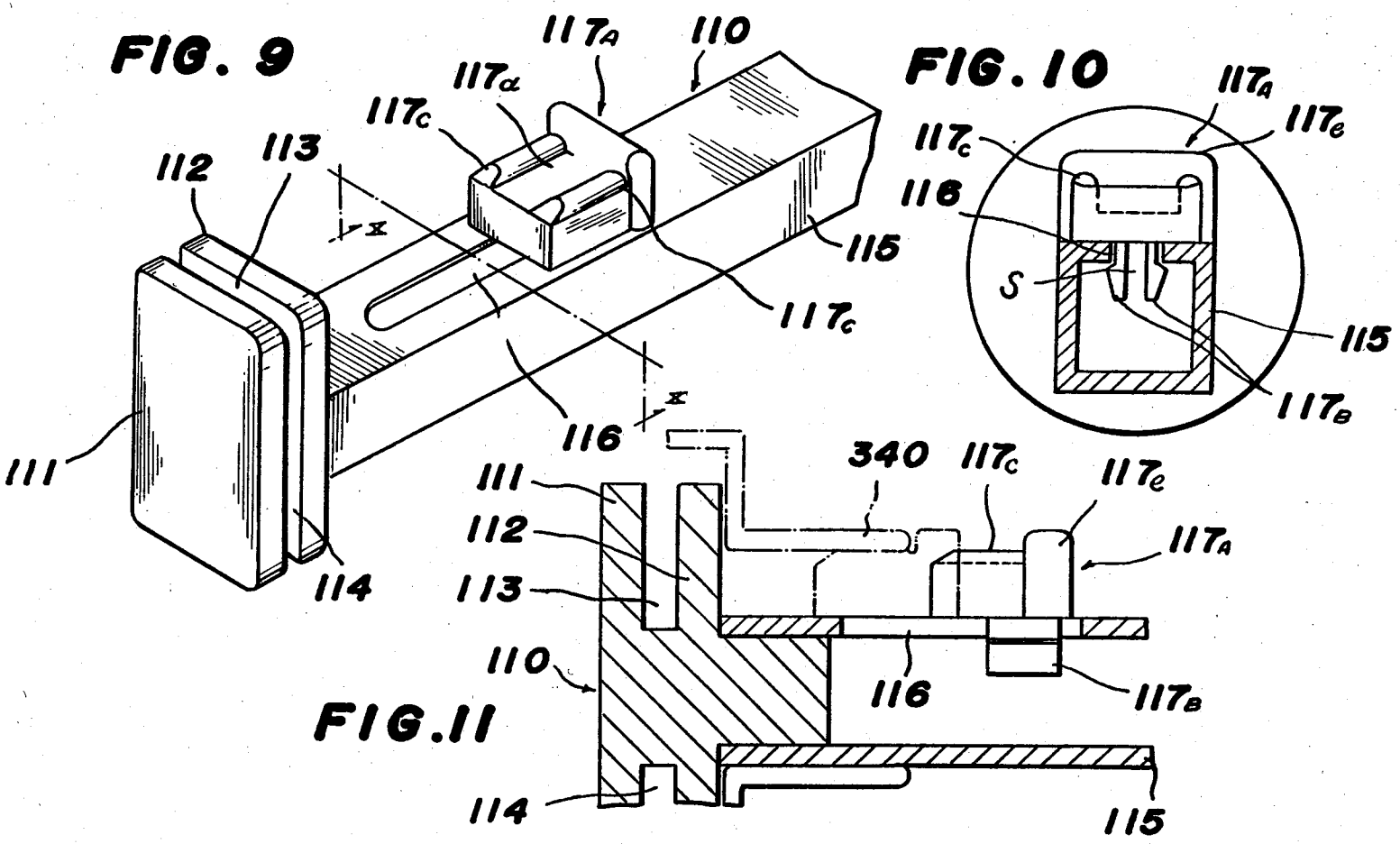
FIG. 9 is a perspective view showing another modification of the hook element.
FIG. 10 is a sectional view of the hook element shown in FIG. 9 along the line X—X therein.
FIG. 11 is a partial longitudinal sectional view of the hook element shown in FIG. 9.

FIG. 9 shows a hook element 110 having another type of stopper 117A.

The stopper 117A has a nylon base, is finished by chrome plating, and consists of a seat portion 117*d* having rib portions 117*c* formed at two sides thereof, and a back portion 117*e* extending upright from the rear end of the seat portion 117*d*.

The rib portions 117*c* extend along the sliding direction of the stopper 117A and are tapered downward at the ends opposing an inner mount base portion 112 of the hook element 110.

The stopper 117A is set such that the distance between the upper ends of the rib portions 117*c* and the upper surface of a hook shaft 115 of the hook element 110 is equal to a clearance L (FIG. 8).

The stopper 117A is fitted in the clearance L to provide the same effect as that of the stopper 117 shown in FIG. 8.

A leg portion 117B as shown in detail in FIGS. 10 and 11 is formed integrally with the lower surface of the stopper 117A.

The leg portion 117B has a slit S which splits it into two parts. The lower portion of each of the two split parts of the leg portion 117B is formed into a wedge-like shape.

The leg portion 117B is fitted into a stopper guide hole 116 formed in the hook element 110 from above.

In the leg portion 117B in this state, the wedge-like portions at the lower ends of the two split parts (along the pulling direction of the leg portion 117B through the guide hole 116) engage with the lower edges of the guide hole 116.

With this structure, the stopper 117A may not inadvertently drop off the hook shaft 115 of the hook element 110.

Figure 12:
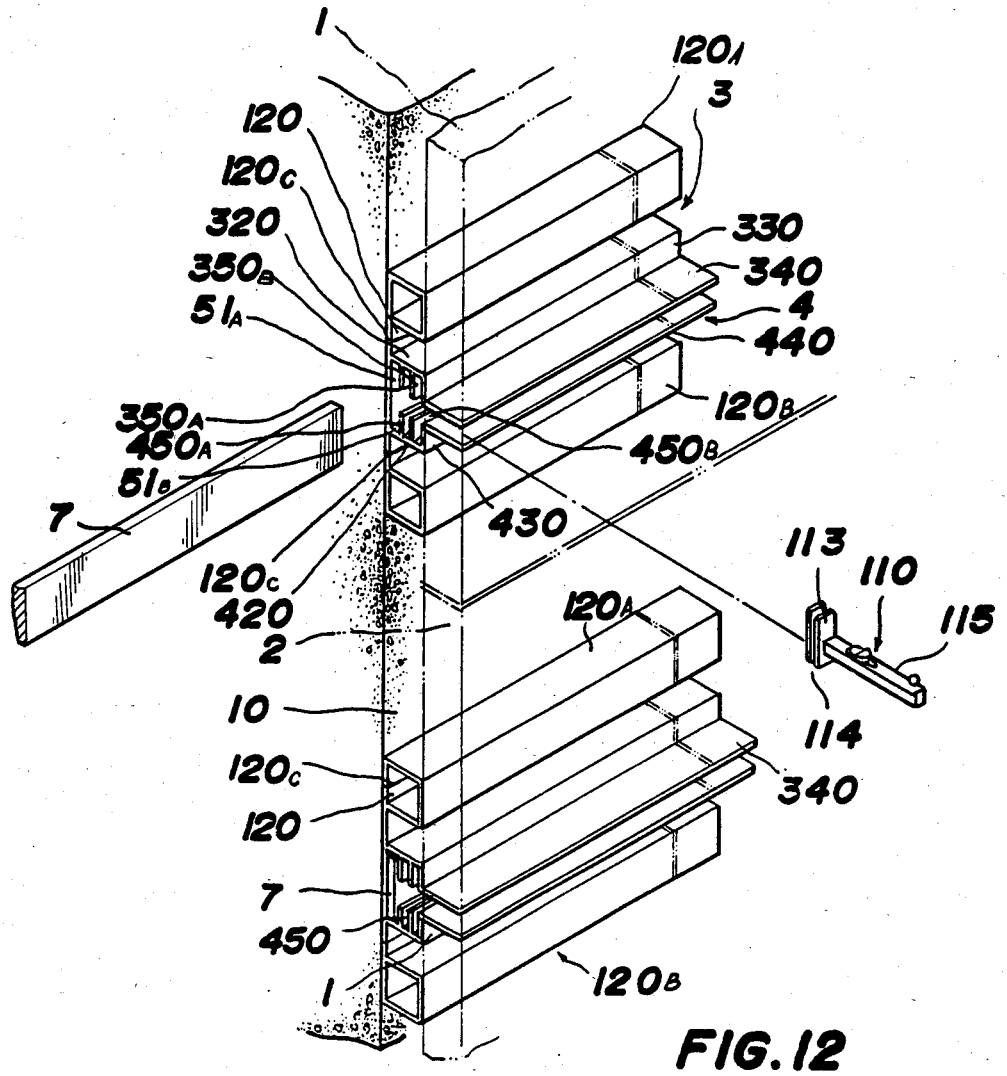
FIG. 12 is a partial perspective view of the wall display structure according to the fourth embodiment of the present invention, the ornamental element being shown associated with the hook element.
Figure 13:
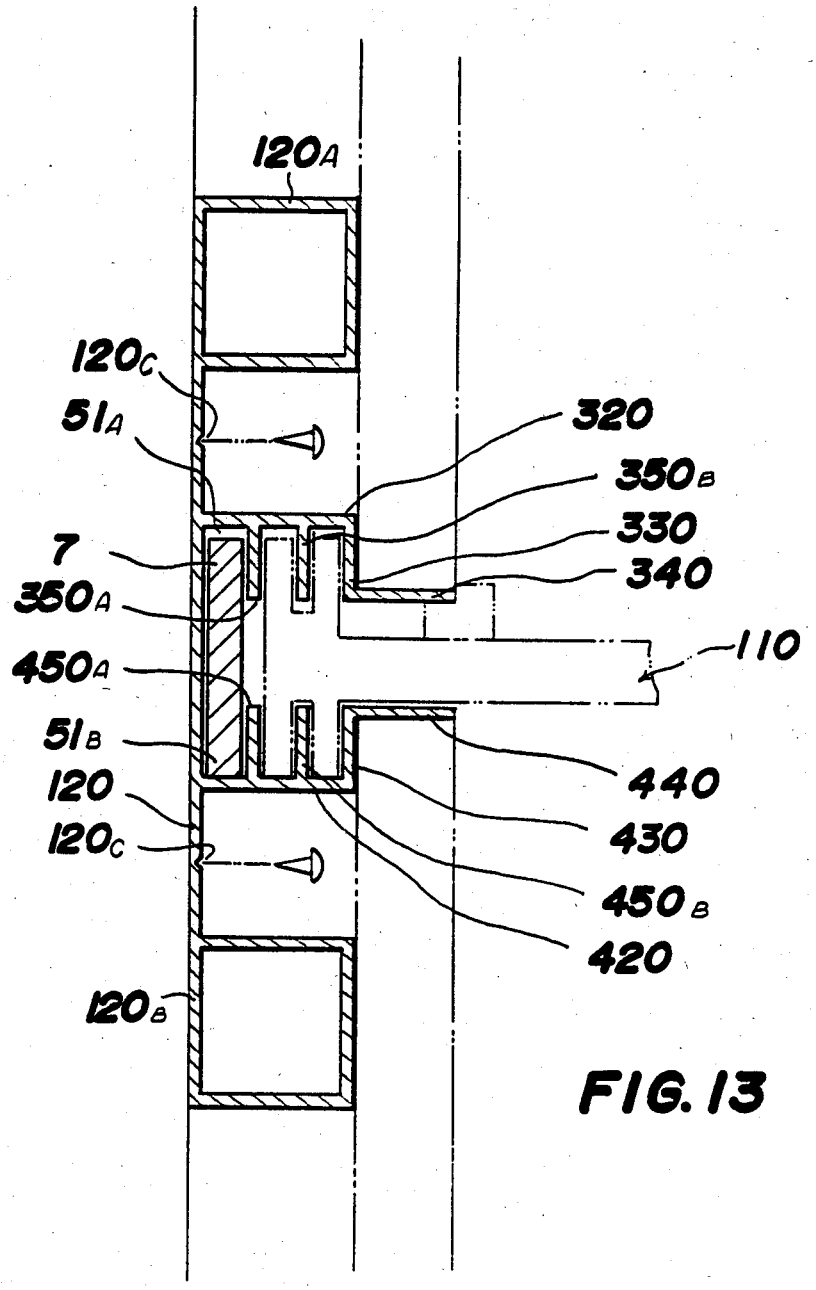
FIG. 13 is an enlarged sectional view of the support portion of the structure shown in FIG. 12.

In the embodiment shown in FIG. 12, reinforcing portions 120A and 120B are formed integrally with the upper and lower edges of a base plate portion 120 as shown in FIG. 7.

The reinforcing portions 120A and 120B comprise square-section pipes and extend parallel to rib portions 320 and 420 of support members 3 and 4, respectively, at a distance therefrom, and extend continuously along the longitudinal direction of the support members 3 and 4.

The reinforcing portions 120A and 120B have a width (measured from a mounting surface 10) which is equal to that of the rib portions 320 and 420.

Thus, modular panels 1 and 2 are abutted against or adhered to flange portions 340 and 440 and web portions 330 and 430 of the support members 3 and 4, respectively. At the same time, the modular panels 1 and 2 are abutted against or adhered to the reinforcing portions 120A and 120B or are screwed thereto.

The reinforcing portions 120A and 120B serve to increase the fixing area of the modular panels 1 and 2 with respect to the support members 3 and 4. Thus, the strength with which the modular panels 1 and 2 are mounted is increased, and the mechanical strength of the support members 3 and 4 themselves is also improved.

In this embodiment, the base plate portion 120 has a pair of screw guide grooves 120C which are respectively defined between the rib portion 320 and the reinforcing portion 120A and between the rib portion 420 and the reinforcing portion 120B.

Since the guide grooves 120C extend continuously along the longitudinal direction of the support members 3 and 4, screwing of the base plate portion 120 to the mounting surface 10 is facilitated.

Inward projections 350A and 350B and inward projections 450A and 450B are formed integrally with the rib portions 320 and 420, respectively.

The inward projections 350A and 350B and the inward projections 450A and 450B extend adjacent and parallel to each other along the longitudinal direction of the support members 3 and 4.

Upper and lower channel portions 51A and 51B oppose each other between the base plate portion 120 and the inward projections 350A and 450A closer thereto.

A plate-like element 7 similar to that described with reference to FIG. 7 is slidably fitted inside the upper and lower channel portions 51A and 51B.

The inward projections 350B and 450B closer to the web portions 330 and 430 are fitted into hook groove portions 113 and 114 of a hook element 110.

In the case of this embodiment, the hook element 110 as shown in FIGS. 8 to 11 is used.

Figure 15:
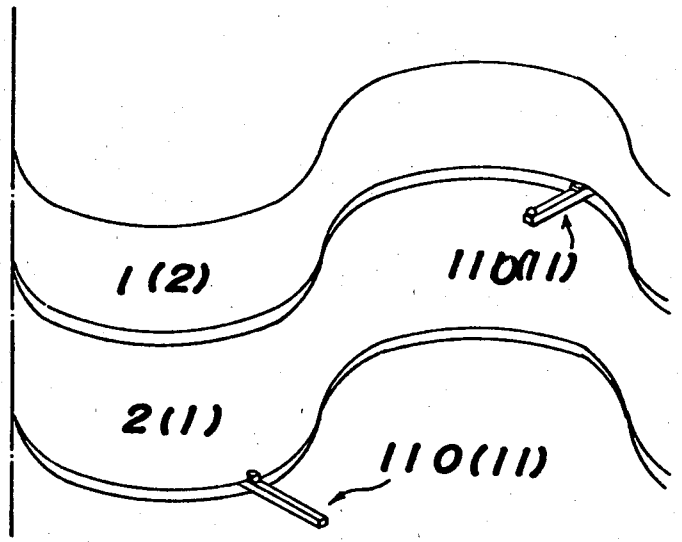
FIGS. 14 and 15 are partial perspective views of wall display structures of different embodiments of the invention.
Figure 14:
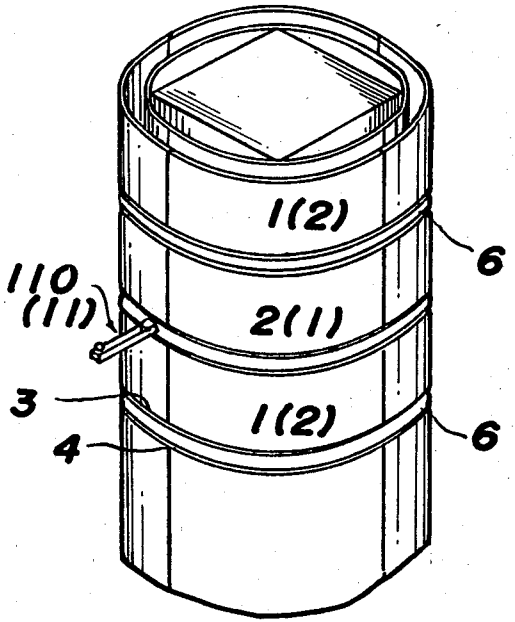

When a plurality of precurved modular panels 1 and 2 as described in the former embodiments and precurved support members 3 and 4 are assembled in the manner as described with reference to the former embodiments, a column display structure as shown in FIG. 14 or an undulating wall display structure as shown in FIG. 15 may be obtained.

Obviously, numerous modifications and variations of the present invention are possible in light of the above teachings. It is therefore to be understood that within the scope of the appended claims, the invention may be practiced otherwise than as specifically described herein.

What is claimed is:

1. A wall display structure for displaying articles or the like, comprising:

a plurality of modular panels for displaying articles, said modular panels being mounted to be vertically and horizontally aligned on a mounting surface;

a plurality of hook elements for hooking the articles thereon and mounted between the vertically aligned modular panels;

first support means for holding a lower edge of an upper modular panel of first and second adjacent panels of said plurality of modular panels which are vertically aligned and mounted on said mounting surface;

second support means for holding an upper edge of a lower modular panel of said first and second adjacent panels of said plurality of modular panels, said second support means being located at a position below said first support member and extending parallel thereto, said first and second support means defining therebetween a transverse channel having a front opening and extending continuously along a longitudinal direction of said first and second support means; and an element positioned entirely within said transverse channel for covering a portion of said mounting surface exposed through said transverse channel wherein said plurality of hook elements further comprise a hook element engaged in said transverse channel at a front side of said element and extending outward through said front opening of said transverse channel.

2. A wall display structure according to claim 1, wherein said hook element further comprises a mount base portion having a shape such that said mount base portion may be inserted into said transverse channel only upon being oriented along the longitudinal direction of said transverse channel; and a hook shaft for holding the article, which extends outward from a surface of said mount base portion which faces away from said transverse channel.

3. A wall display structure according to claim 2, wherein said hook shaft of said hook element further comprises a stopper guide hole of an elongated shape formed in an upper surface of said hook shaft; a stopper loosely fitted in said stopper guide hole and movable along an axial direction of said stopper; and a step formed at a hook engaging side of said stopper and engaging with an upper edge of said front opening of said transverse channel when said mount base portion is engaged in said transverse channel.

4. A wall display structure according to claim 1, wherein said first support means further comprises an upper rib portion which extends horizontally outward from said mounting surface and continuously along the longitudinal direction of said first and second support means, a depending web portion which depends from a distal edge of said upper rib portion and is adhered to a portion of a rear surface of the lower edge of the upper modular panel, and an upper flange portion which extends horizontally outward from a lower edge of said depending web portion and is adhered to a lower end face of the upper modular panel; and wherein said second support means further comprises a lower rib portion which extends horizontally outward from said mounting surface parallel to said upper rib portion so as to define said transverse channel therebetween, an upright web portion which extends upward from a distal edge of said lower rib portion and is adhered to a portion of a rear surface of the upper edge of the lower modular panel, and a lower flange portion which extends horizontally outward from an upper edge of said upright web portion and is adhered to an upper end face of the lower modular panel so as to define said transverse channel together with said upper flange portion.

5. A wall display structure according to claim 4, wherein each of said first and second support means has an outward flange which extends from a proximal edge of a corresponding one of said upper and lower rib portions and is connected to said mounting surface.

6. A wall display structure according to claim 4, wherein each pair of said first and second support means has a base plate in which said upper and lower rib portions are formed integrally with each other and which is fixed to said mounting surface.

7. A wall display structure according to claim 4, wherein said upper and lower rib portions have an integrally formed partition wall constituted by inner surfaces thereof extending in opposing directions, said partition wall partitioning an interior of said transverse channel into an element housing at the side of said mounting surface and upper and lower hook engaging grooves at the side of said front opening.

8. A wall display structure according to claim 7, wherein said partitioning wall is concealed by said depending and upright web portions such that said partitioning wall may not be exposed through said front opening of said transverse channel.

* * * * *